US010098428B2

(12) United States Patent
Van der Merwe

(10) Patent No.: US 10,098,428 B2
(45) Date of Patent: Oct. 16, 2018

(54) HORIZONTAL ROTATING SPINEBOARD WASHER

(71) Applicant: Izak Van der Merwe, Tampa, FL (US)

(72) Inventor: Izak Van der Merwe, Tampa, FL (US)

( * ) Notice: Subject to any disclaimer, the term of this patent is extended or adjusted under 35 U.S.C. 154(b) by 0 days.

(21) Appl. No.: 15/360,920

(22) Filed: Nov. 23, 2016

(65) Prior Publication Data

US 2017/0151587 A1 Jun. 1, 2017

Related U.S. Application Data

(60) Provisional application No. 62/260,310, filed on Nov. 26, 2015.

(51) Int. Cl.

| | |
|---|---|
| ***B08B 3/02*** | (2006.01) |
| ***A45C 11/00*** | (2006.01) |
| ***A45C 13/00*** | (2006.01) |
| ***A45F 5/00*** | (2006.01) |

(52) U.S. Cl.

CPC ..... *A45C 11/00* (2013.01); *A45C 13/002* (2013.01); *A45F 5/00* (2013.01); *B08B 3/022* (2013.01); *A45C 2011/001* (2013.01); *A45C 2011/002* (2013.01); *A45C 2011/003* (2013.01); *A45C 2200/15* (2013.01)

(58) Field of Classification Search

CPC ..... A45C 11/00; A45C 2011/001; A45C 2011/002; A45C 2011/003; A45C 2200/15; B08B 3/022

See application file for complete search history.

(56) References Cited

U.S. PATENT DOCUMENTS

| | | | | |
|---|---|---|---|---|
| 3,583,414 | A * | 6/1971 | Rose | A01K 41/065 134/133 |
| 5,472,004 | A * | 12/1995 | Gilliard | B08B 3/02 134/111 |
| 5,549,759 | A * | 8/1996 | Lithander | B08B 3/02 134/153 |
| 2002/0078515 | A1* | 6/2002 | Biddix | A46B 13/04 15/77 |
| 2017/0151587 | A1* | 6/2017 | Van der Merwe | B08B 3/022 |

* cited by examiner

*Primary Examiner* — Sharidan Carrillo

(74) *Attorney, Agent, or Firm* — Justin Luby

(57) ABSTRACT

A rotating spine board washer which utilizes a rotisserie style racking system that allows multiple spine boards to be configured into a tube shape. The tube shaped rack is connected to a motor that rotates the rack 360 degrees repeatedly. Located inside and outside of the hollow tube shaped rack are manifolds that run the length of the rack, with a plurality of spray nozzles located along the manifolds which direct wash solution at the inward facing surface and outward facing surface of the spine boards as they rotate around the fixed spray nozzles.

1 Claim, 8 Drawing Sheets

HORIZONTAL ROTATING SPINEBOARD WASHER

CROSS-REFERENCE TO RELATED APPLICATIONS

This application claims priority to provisional application U.S. Ser. No. 62/260,310 filed Nov. 26, 2015. Said application is incorporated by reference herein in its entirety.

FIELD OF THE INVENTION

The present invention relates generally to medical transport boards, sometimes referred to as spine boards, and, more particularly, to an apparatus for cleaning and disinfecting such boards.

BACKGROUND

Medical transport boards are boards that are generally used by emergency medical personnel for transporting accident victims. These boards, which are sometimes referred to as spine boards, are typically made of plastic, fiberglass, or other synthetic material and are designed to be lightweight but strong, stiff boards that prevent movement of a person strapped to the board during transport of the person.

Since these boards are commonly used to transport accident victims, the boards are frequently contaminated with blood or other body fluids and must be thoroughly cleaned and disinfected after each use. Historical methods of cleaning such boards include spraying the boards with water, soap solutions, disinfectants and manually scrubbing the boards by hand to remove any material on the boards.

A typical emergency rescue vehicle, such as an ambulance, will carry 4 spine boards onboard. In between operations it is important that these 4 boards can be cleaned rapidly so that the rescue vehicle is available for immediate usage if needed.

Recent trends have migrated towards utilizing automated wash systems to clean such boards between uses. The earliest entry into the field of automated spine board washing utilized stationary racks to hold and support the spine boards, and stationary spray nozzles directed at the spine boards in the racks. The spray nozzles are supplied a high pressure cleaning solution through a pumping system, which when directed towards the boards, impinges the blood or other body fluids from the surface of the boards. Advantages of this type of automated washing system are that it can be configured to wash multiple boards at a time. However, the disadvantage is that due to space constraints, the equipment is unable to impinge 100% of the spine board surface areas, therefore leading to ineffective cleaning.

A subsequent embodiment of the automated spine board washer utilized rotating spray arms in place of stationary nozzles on racking systems. The advantage of the rotating spray arms is that they are less expensive to construct and utilize because could effectively clean a spine board using less fewer nozzles and less water. The disadvantage of the rotating spray arms is that they consumed more space than the nozzles, and therefore, fewer spine boards could be cleaned simultaneously, again, creating longer than ideal wash times.

Accordingly, there is a need for an apparatus that is functional to clean a plurality of spine boards simultaneously while effectively impinging 100% of surface areas of the spine boards.

Additionally, there is a need for an apparatus that is functional to clean a plurality of spine board simultaneously in a short period of time.

Additionally, there is a need for an apparatus that is functional to clean a plurality of spine board simultaneously that requires a small footprint.

SUMMARY

The present invention addresses the shortcomings of prior art attempts to automate the cleaning of spine boards by providing a cleaning system that rotates a plurality of spine boards around a plurality stationary spray nozzles creating a cleaning system that effectively impinges 100% of the surfaces of multiple spine boards simultaneously, creating a cleaning system the is more effective and efficient than it predecessors.

The rotating spine board washer of the present invention utilizes a rotisserie style racking system that allows multiple spine boards to be configured into a square tube shape. The square tube shaped rack is connected to a motor that rotates the rack 360 degrees repeatedly.

Located inside and outside of the hollow square tube shaped rack are manifolds that run the length of the rack, with a plurality of spray nozzles located along the manifolds which direct wash solution at the inside and outside of the spine boards which create the square tube shape.

Pumps supply high pressure wash solution to the nozzles through the manifolds which impinge wash solution against the rotating spine boards as they travel through the path of spray with sufficient force and flow to clean and disinfect the entire surface of the spine board.

The entire assembly is contained within a watertight housing unit, which contains the wash solution during the automated cycle is operating. The housing contains a single door whereby spine boards can be installed and removed from the rotisserie style racking system before and after cleaning. Usage of a single door for loading and unloading allow for the equipment to utilize a smaller footprint for operation than other units that have separate loading and unloading locations.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

DETAILED DESCRIPTION OF THE INVENTION AND PREFERRED EMBODIMENT

Figure 1:
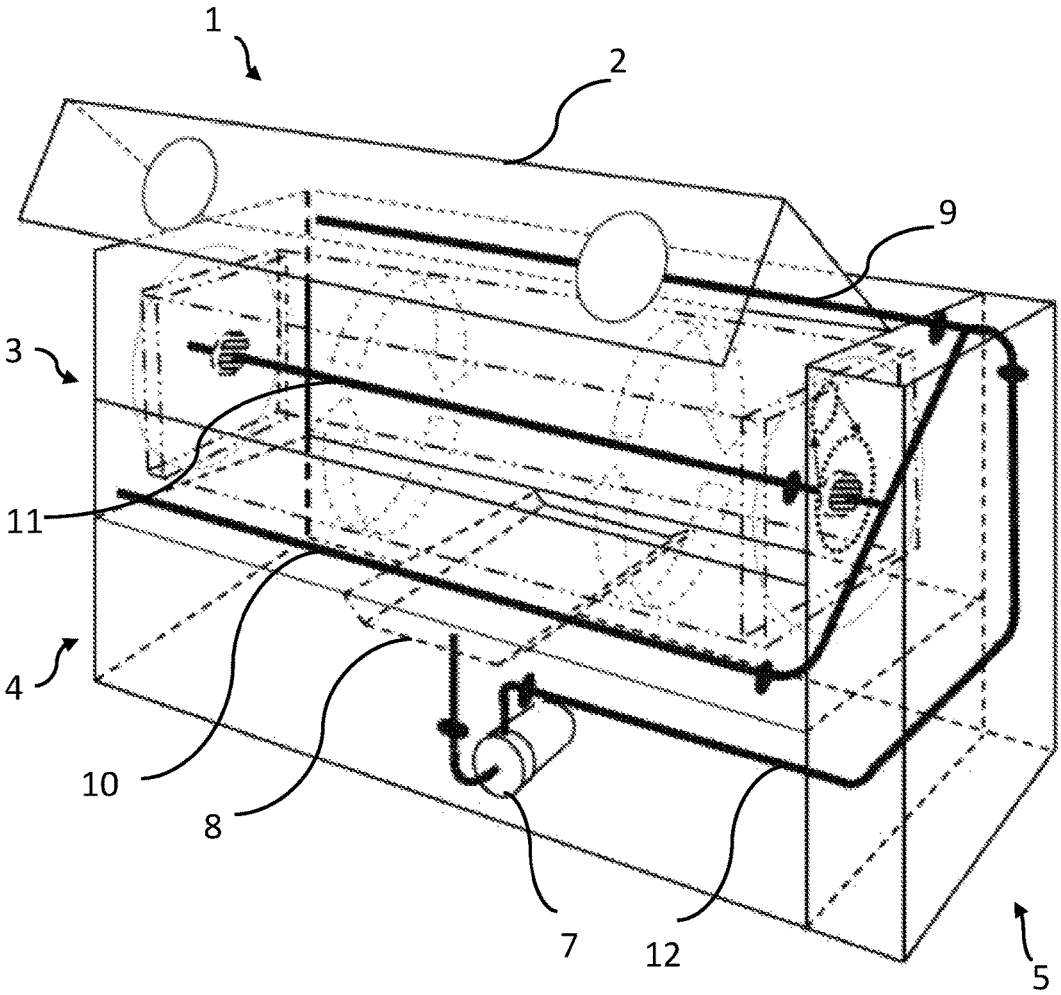
FIG. 1 illustrates a perspective view drawing of the assembled rotating spine board washer with a representation of the spine board rack.
Figure 2:
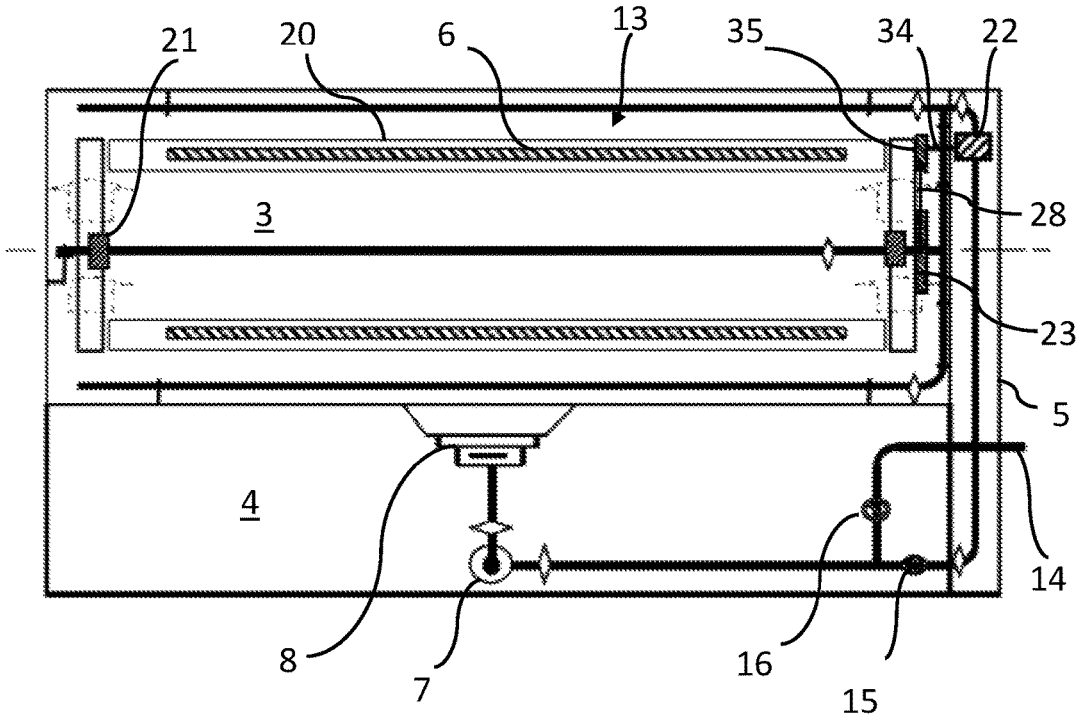
FIG. 2 illustrates a front view cross-sectional drawing of the assembled rotating spine board washer with a representation of the spine board rack.

As shown in FIGS. 1 and 2, the rotating spine board washer of the present invention includes a housing 1 with a hinged lid 2. The housing is divided into an upper wash compartment 3, a lower pump compartment 4 and side compartments for piping and drive motor 5. The upper wash compartment 3 provides a watertight enclosure for cleaning the spine boards 6, while lower pump compartment stores a recirculation pump 7, for circulating a cleaning and disinfecting fluid (disinfectant) into upper wash compartment 3. The housing may be made of a variety of materials, including stainless steel (preferred), aluminum, or plastic.

As shown in FIGS. 1, 2, 3 & 4, the lower compartment 4 houses a pump 7 which is used to pressurize and circulate the wash solution. Wash solution is drawn into the pump from the reservoir 8 on the underside of the wash chamber 3 and is discharged into piping that feeds the spray manifolds 9, 10, 11 that will be detailed later in this application. While in the preferred embodiment of the invention the pump 7 is a 3 horsepower centrifugal pump, the pump could be any size and type which can deliver sufficient flow and pressure wash solution to effectively clean the spine boards 6. In addition to pump sizing, it is also preferred that the pump 7 be constructed of stainless steel or materials that are rust and chemical resistant so that is does not rust or deteriorate with the wash solution used to clean the spine boards 6.

Figure 3:
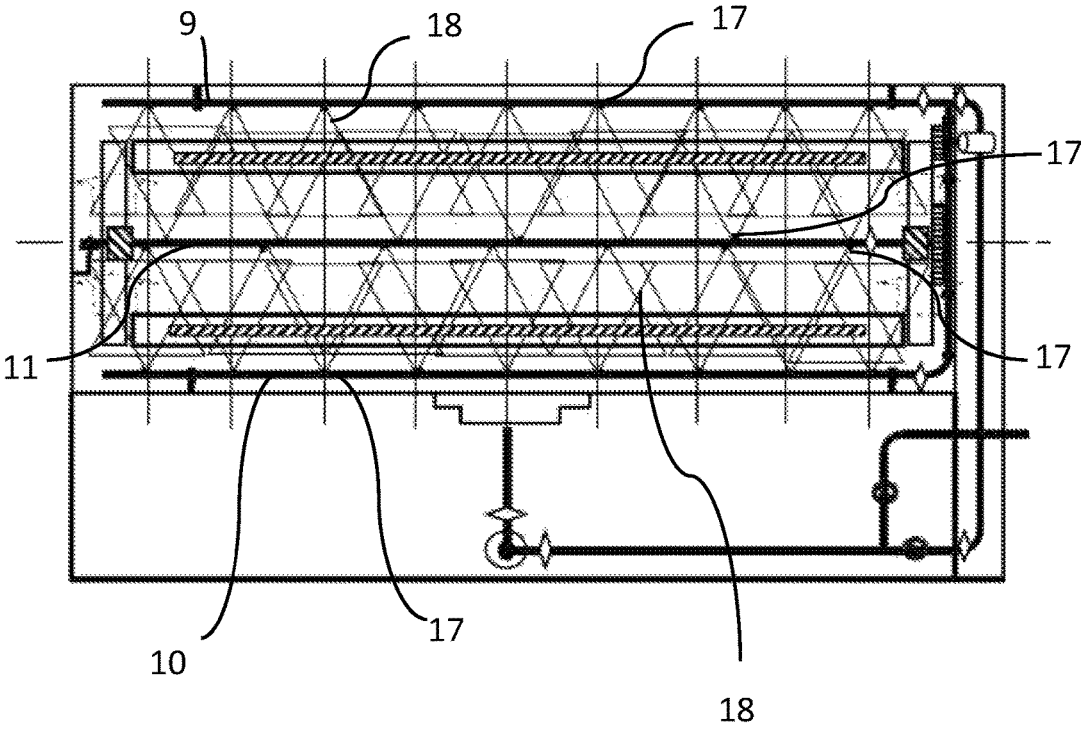
FIG. 3 illustrates frontal view of the rotating spine board washer assembly depicting the spray coverage of the nozzles.
Figure 4:
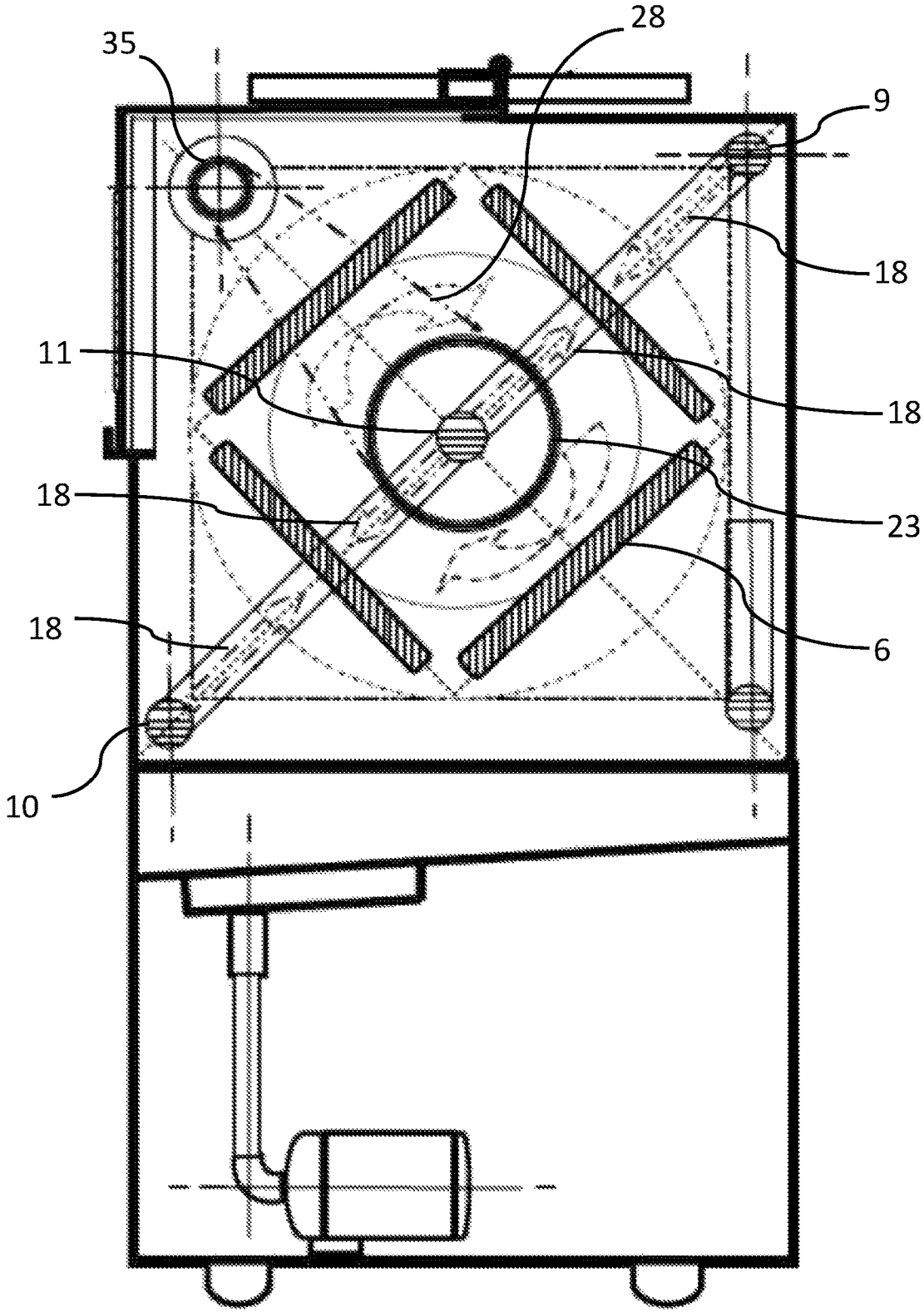
FIG. 4 illustrates side view of a flow diagram of the rotating spine board washer assembly.

As shown in FIGS. 1,2, & 3, the piping 12 from the outlet of the pump services 3 manifolds 9, 10, 11 located in the upper wash chamber 3. The manifolds 9, 10, 11 in the upper wash chamber 3 are located above 9, below 10, and through the center 11 of the spine board rack 13. While the preferred embodiment of the invention utilizes 3 manifolds 9, 10, 11 placed in the above described locations, it is contemplated in this invention that any number of manifold could be utilized and these manifolds could be placed in any arrangement within the upper wash chamber 3 that can effectively clean the spine boards 6. In addition to manifold location, it is also preferred that the piping 12 and manifolds 9, 10, 11 be constructed of stainless steel or materials that are rust and chemical resistant so that is does not deteriorate with the wash solution used to clean the spine boards 6.

As shown in FIGS. 2 & 3, there is a drain line 14 and two valves 15, 16 installed in the piping from the outlet of the pump 7 which services the 3 manifolds 9, 10, 11. This drain line 14 allows the wash solution to be drained from the machine after use.

As shown in FIGS. 1, 2 & 3, the manifolds 9, 10, 11 traverse the width of the upper wash chamber 3. Located throughout the length of the manifolds are a plurality of spray nozzles 17. The spray nozzles 17 direct and disperse wash solution at the spine boards 6 with sufficient flowrate and pressure to effectively clean the spine boards 6. In the preferred embodiment the nozzles 17 disperses wash solution in a fan pattern 18. As depicted in FIG. 3, in the preferred embodiment the quantity, design, and arrangement of the nozzles 17 ideally should be such that during operation that the nearly the all surfaces of the spine board 6 are directly impinged by wash solution from the nozzles 17.

As shown in FIGS. 1, 2, & 3, located in the upper wash chamber 3 is a square tube shaped spine board rack 13 where spine boards 6 can be installed into the rotating spine board washer for cleaning. Once installed, the spine boards 6 will rotate around and between the center spray manifold 11 and the two outer spray manifolds 9 & 10, located in the upper and lower sections of the upper wash chamber 3. During operation of the washer, the manifolds 9, 10, 11 and nozzles 17 will remain fixed, with a high pressure output of cleaning solution focused at a particular location, and the rotation of the rack 13 will move the spine boards 6 in front of the high pressure spray 18 from the nozzles 17.

Figure 6:
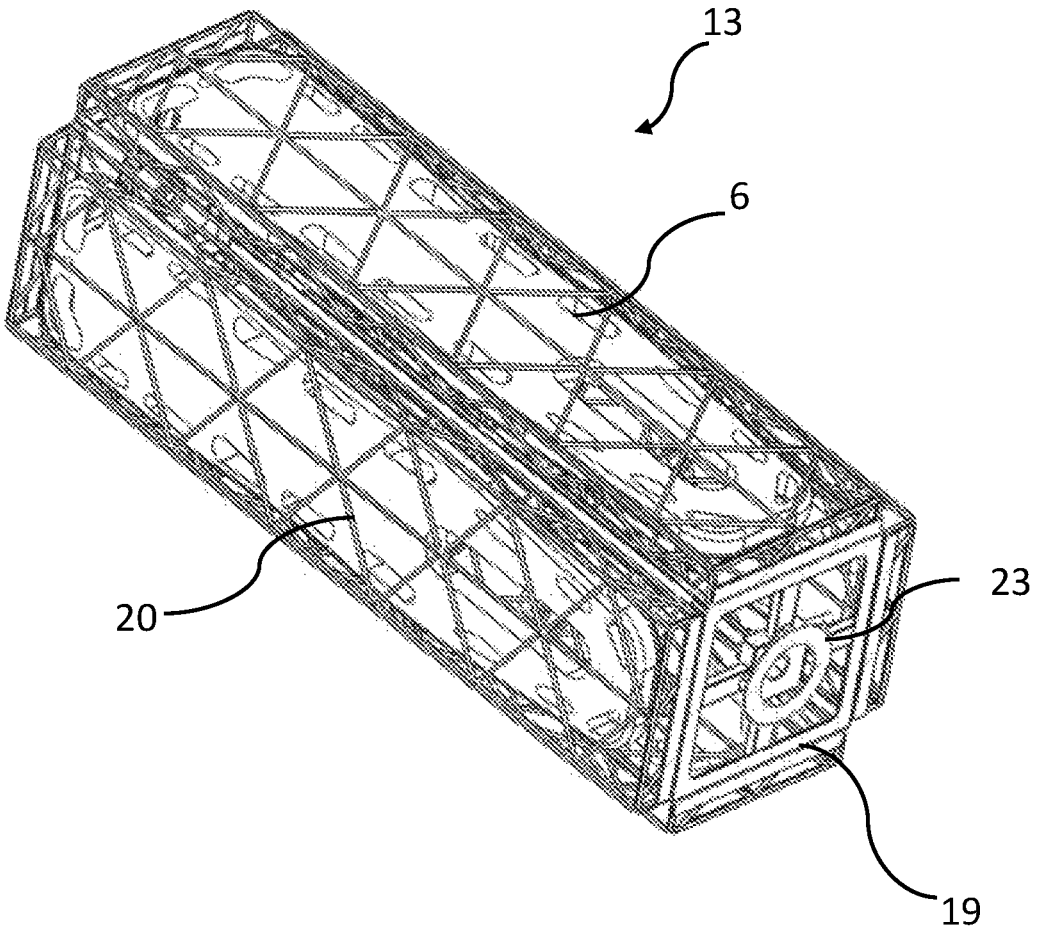
FIG. 6 illustrates right side perspective view drawing of the spine board rack.
Figure 7:
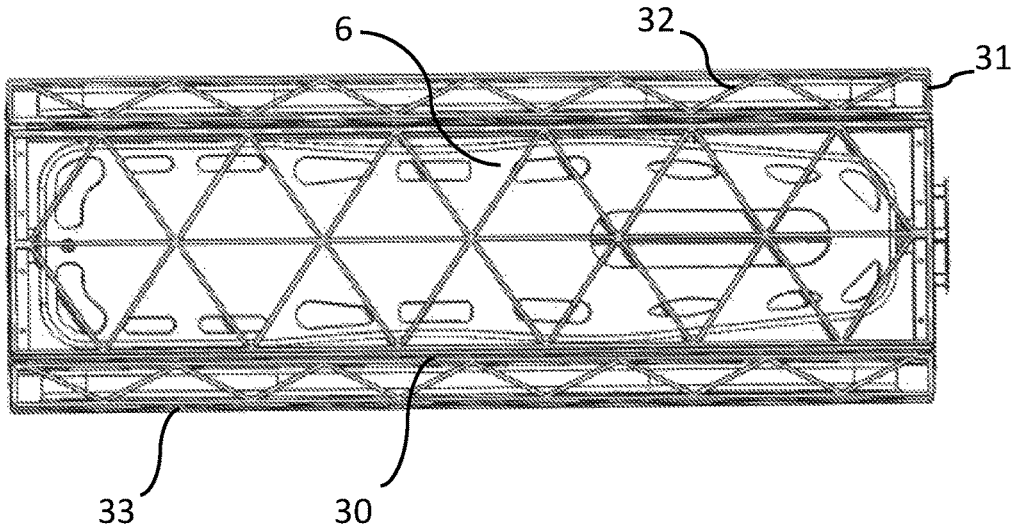
FIG. 7 illustrates a front view drawing of the spine board rack.
Figure 8:
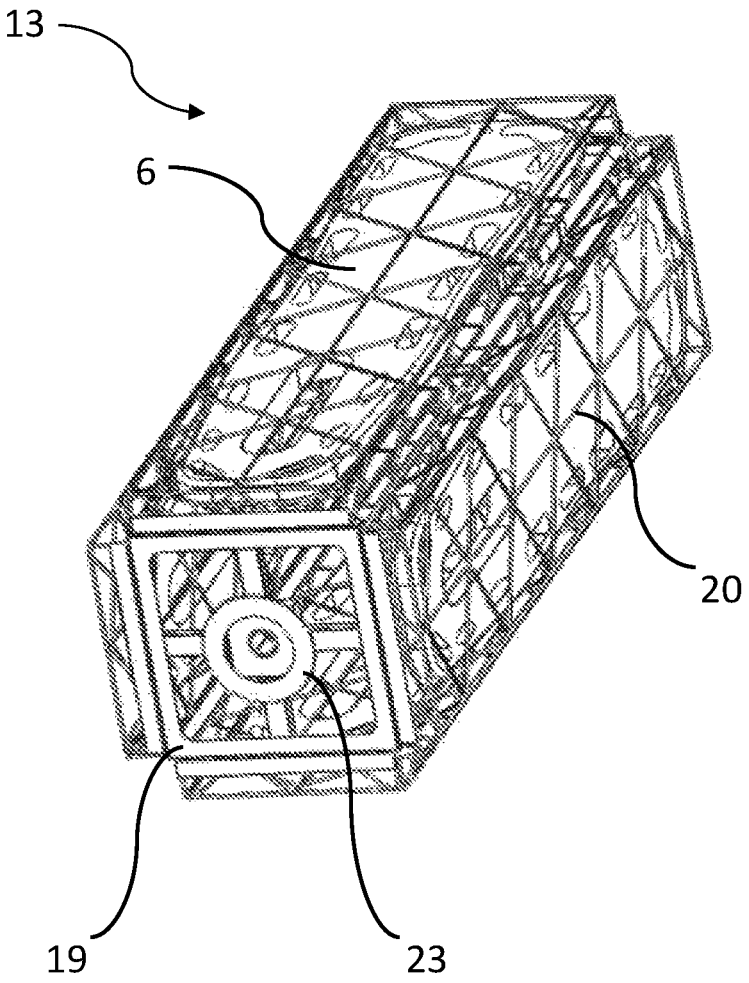
FIG. 8 illustrates left side perspective view drawing of the spine board rack.

Referring to FIGS. 6, 7, & 8, at either end of the spine board rack 13 which holds the spine boards 6 is an end piece 19. The purpose of the end pieces 19 are to prove support to the individual spine board holders 20 as well as the bearings 21 which will be installed in the center of the end piece 19, allowing the rack to rotate around the center manifold 11. Referring to FIG. 3, the purpose of one of the end pieces 19 on the side of the drive motor 22 is located also to provide an sprocket 23 where a drive motor 22 can be connected to and provide motive force to rotate the rack 13.

The preferred embodiment uses a square tube shaped rack 13 that cleans four spine boards 6 at a time because the size/cost efficiency combination that the square tube shaped rack 13 creates is ideal for commercial efficacy. Additionally, the size is ideal because the typical emergency rescue vehicle will carry four spine boards 6 onboard, therefore, your typical load size would be four boards. However, any multitude of rack shapes could be used, such as a triangular shaped tube or a hexagonal shaped tube. The only constraint is that the shape and placement of the rack and spray manifolds allow for nozzles 17 impinge both the inside and outside of the spine boards 6 when installed in the rack.

Figure 5:
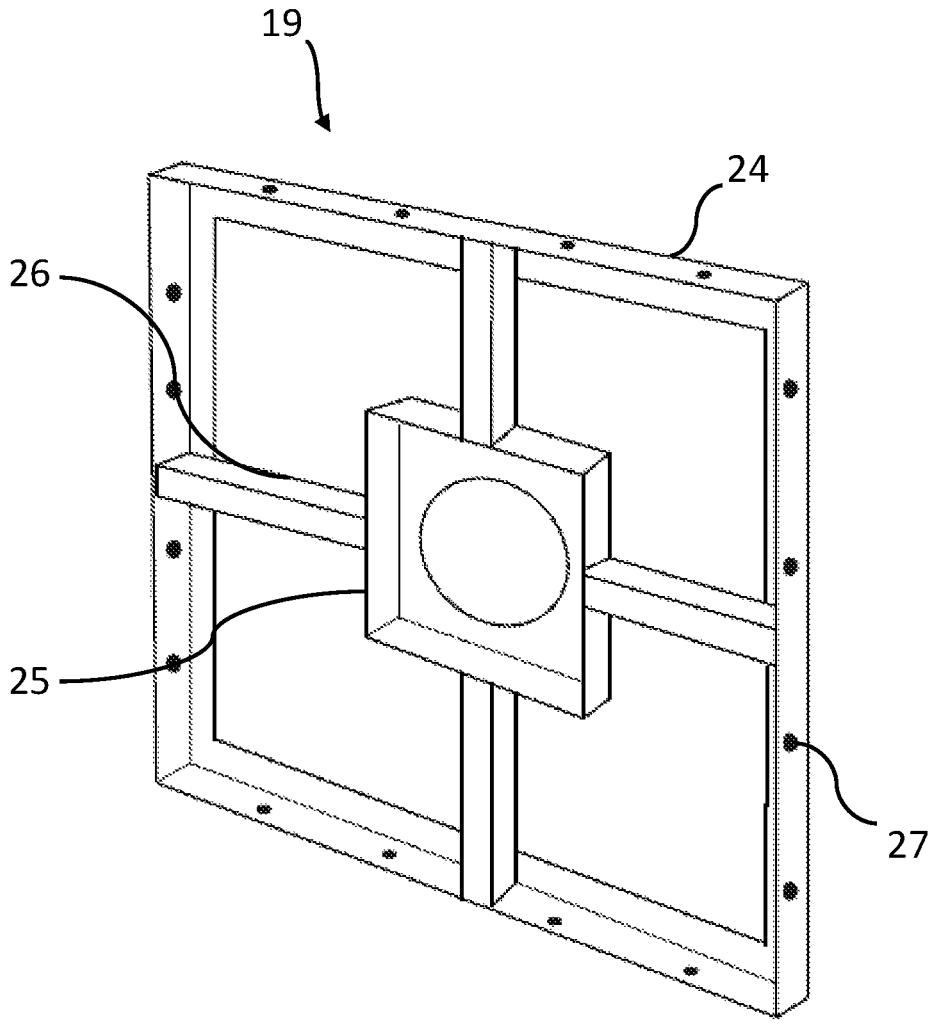
FIG. 5 illustrates a perspective view drawing of a square rack support frame, and bearing block support frame.

Referring to FIG. 5, the end piece 19 is comprised of an outer square 24, a smaller square inner 25, and four support pieces 26 that center and support the inner square 25 inside of the outer square 24. In the preferred embodiment all of the components of the end pieces 19 are constructed of stainless steel, due to its rust and corrosion resistance, as well as its machine-ability. However, the components of the end pieces 19 could be constructed of any materials known to those skilled in the art that could be used to create a sound structure that would also be sufficiently rust and corrosion resistant.

Referring to FIG. 5 throughout the outer square there are a plurality of holes 27 drilled through the component. The function of these holes 27 is to allow the individual spine board holders 20 to be bolted to the end pieces 19. In the preferred embodiment the individual spine board holders 20 are bolted to the end pieces 19, however, this could be achieved through welding, riveting, or any other method known to those skilled in the art.

Referring to FIGS. 6, 7, & 8, affixed to one of the end pieces is a sprocket 23. The sprocket will be used to transfer rotational speed from the drive motor 22 via chain drive 28. In the preferred embodiment all of the sprocket 23 is constructed of stainless steel, due to its rust and corrosion resistance, as well as its machine-ability. However, the sprocket 23 could be constructed of any materials known to those skilled in the art that could be used to create a sound structure that would also be sufficiently rust and corrosion resistant.

The preferred embodiment utilizes a sprocket 23 and chain drive 28 system to transfer rotational force from the motor to the rotating rack due to its cost effectiveness and low maintenance. However, this transfer of force could be achieved through a belt and pulley system, direct drive system, or any other method known to those skilled in the art.

Located in and affixed to the inner square 24 of each of the end pieces is a square pillow block bearing 21. Running through the center of the pillow block bearing 21 is the center spray manifold 11 coming from the pump. The pillow block bearing 21 allows the manifold 11 to remain stationary in the upper wash compartment 3 while spine board rack 13 is able to independently rotate around the center manifold 11 and nozzles 17, thereby assuring that the entire inner surface of the spine boards 6 is impinged with cleaning solution. In the preferred embodiment the pillow block bearing 21 is constructed of a stainless steel housing with delrin inserts, due to its rust and corrosion resistance, as well as its machine-ability. However, the pillow block bearing 21 could be constructed of any materials known to those skilled in the art that could be used to create a smooth rotational motion that would also be sufficiently rust and corrosion resistant.

Referring to FIGS. 6, 7, & 8 traversing between each of the four sides of the two end pieces 19 are four individual spine board holders 20. Each individual spine board holder 20 is comprised of a frame base 30, two (2) frame ends 31, two (2) frame sides 32, a frame top 33. Additionally, one of the frame sides 32 in each of the spine board holders 20 is hinged to allow the holder 20 to be opened and closed to insert and remove spine boards 6. In the preferred embodiment the frame base 30, two (2) frame ends 31, two (2) frame sides 32, a frame top 33 are all constructed of ¼ inch diameter wire coil. The use of wire coil is preferred to solid metal because the coil will allow wash solution to permeate through it to the edges of the spine boards it is covering, allowing for more effective cleaning. Additionally, in the preferred embodiment all of these components are constructed of stainless steel, due to its rust and corrosion resistance, simple drain-ability as well as its machine-ability. However, these components of the could be constructed of any materials known to those skilled in the art that could be used to create a sound structure that would also be sufficiently rust and corrosion resistant.

In the preferred embodiment the individual spine board holders 20 are constructed by bending and notching the wire coil on blocks and the seam welding each of the corners to add rigidity to the structures. While other methods known to those skilled in the art, such as bolting or riveting could be used to construct these structures, this method is preferred due to its low cost of materials and ease of implementation.

Referring to FIGS. 2 & 3, in the side compartment 5, a motor 22 is mounted on the exterior of the wash chamber 3. The shaft 34 of the motor 22 will protrude through a seal and into the upper wash chamber 3. On the end of the motor shaft 34 will be mounted a sprocket 35, which will be attached to the aforementioned sprocket 23 on the end piece via a chain 28. The motor speed and the ratio of the diameter of the sprockets 35 on the motor to the diameter of the sprocket 23 on the end piece 19 must all be sized proportionally to create the desired rotational speed of the spine board rack 13.

To operate the rotating spine board washer, the operator must first open the hinged lid 2 on the housing 1 and manually rotate the rack 13 into a position where he can install a spine board 6 into an individual spine board holder 20. Once in place the operator will open the hinged frame side 32. Once open, the spine board 6 can be installed into the individual spine board holder 20, and the hinged frame side 32 of the individual spine board holder 20 can be closed. The operator will then repeat this procedure 3 more times for the remaining available individual spine board holders 20.

Once the spine boards 6 have been loaded into rotating spine board washer (or before, the order of operations at this point is not critical), the operators will mix a predetermined amount of wash solution into a bucket or other apparatus and pour it into the wash compartment 3 through the hinged lid 2. There should be sufficient amount of wash solution to maintain a prime on the pump 7 when the equipment is operating.

Once the spine boards 6 and wash solution have been loaded into the equipment the operator will start the pump 7 and the motor 22 driving the rotation of the rack 13. The operator will allow the equipment to continue to operate for a predetermined amount of time which the operator believes from experience is sufficient to effectively clean the amount and type of materials which are contaminating the spine boards.

Once the predetermined amount of time has passed, the operator will turn off the motor 22 driving the rotation of the rack. The operator will then close the valve 15 which supplies wash solution to the manifolds 9, 10, 11 and will open the valve 16 to the drain line 14, while the pump is running. This will evacuate the contaminated wash solution from the washer. Once all of the contaminated wash solution has been evacuated, the pump 7 will be turned off, the valve 16 to the drain line 14 closed, and the valve 15 to the manifolds 9, 10, 11 supply line opened.

At this point the wash cycle is complete and the spine boards 6 can be removed in a similar manner as they were installed, or additional wash/rinse cycles can be run in a similar manner, as required.

In an alternate embodiment of the invention, a pre-programmed circuit board or logic controller can be used to automate start and stop of the wash cycle, pump 7 and motor 22, as well as opening and closing of valves 15, 16 to remove the requirement for operator intervention during the cleaning process.

In another alternate embodiment of the invention, pumps will be utilized to deliver water and detergent/disinfectant into the washer, to remove the need for the operator to manually fill the washer before and during cleaning cycles.

It would be appreciated by those skilled in the art that various changes and modifications can be made to the illustrated embodiments without departing from the spirit of the present invention. All such modifications and changes are intended to be covered by the appended claims.

What is claimed is:

1. A method for cleaning spine boards comprising:

installing one or more spine boards in a horizontal hollow tubular rack which will hold the spine boards in fixed position while said rack can be rotated;

running at least one fixed position spray manifold horizontally inside of said hollow tubular rack with a plurality of nozzles directed at the spine boards;

running at least one fixed position spray manifold horizontally outside of said hollow tubular rack with a plurality of nozzles directed at the spine boards;

supplying said inside and outside spray manifolds with a pressurized wash solution to effectively remove contaminates from the spine boards;

rotating said rack and spine boards between said inside and outside spray manifolds until said wash solution has removed the contaminates from the surface of the spine boards.

* * * * *